US005832333A

United States Patent [19]

Umeda et al.

[11] Patent Number: 5,832,333

[45] Date of Patent: Nov. 3, 1998

[54] ELECTROSTATIC RECORDING APPARATUS AND ELECTROSTATIC RECORDING METHOD

[75] Inventors: Takao Umeda; Seiji Maruo; Hiroyuki Mabuchi, all of Ibaraki, Japan

[73] Assignee: Hitachi Koki Co., Ltd., Tokyo, Japan

[21] Appl. No.: 721,235

[22] Filed: Sep. 26, 1996

[30] Foreign Application Priority Data

Sep. 29, 1995 [JP] Japan ..... 7-252505

[51] Int. Cl.[6] ..... G03G 15/00; G03G 15/02

[52] U.S. Cl. ..... 399/48; 399/50

[58] Field of Search ..... 399/40, 48, 50

[56] References Cited

U.S. PATENT DOCUMENTS 4,078,929 3/1978 Gundlach ..... 96/1.2
4,416,533 11/1983 Tokunaga et al. ..... 399/298 X
4,791,452 12/1988 Kasai et al. ..... 399/40
4,860,048 8/1989 Itoh et al. ..... 399/40
5,365,325 11/1994 Kumasaka et al. ..... 399/40

*Primary Examiner*—Fred L. Braun
*Attorney, Agent, or Firm*—Sughrue, Mion, Zinn, Macpeak & Seas, PLLC

[57] ABSTRACT

An electrostatic recording apparatus includes a background potential detector (12*a*, 12*b*, 13*a* and 13*b*) for detecting the potential (VMc) of a background region adjacent to a normal development region (having VHc) and the potential (VMd) of a background region adjacent to a reversal development region (having VLd), and a controller (25) for controlling a charge voltage, exposure intensity, and/or developing bias voltage according to the output of the background potential detector to eliminate a fogging phenomenon.

6 Claims, 4 Drawing Sheets

VHa
VMa
VLa
VHb
VLb
VHc
VMc
VMd
VLd
0
NORMAL DEVELOPMENT REGION
REVERSAL DEVELOPMENT REGION
BACKGROUND REGION

ELECTROSTATIC RECORDING APPARATUS AND ELECTROSTATIC RECORDING METHOD

BACKGROUND OF THE INVENTION

1. Field of the Invention

This invention relates to an electrostatic recording apparatus such as a laser printer and a copying machine, and to an electrostatic recording method.

2. Description of the Prior Art

An electrostatic recording system, called "a tri-level xerography", has been disclosed under U.S. Pat. No. 4,078,929. In the system, a latent image is formed which is a combination of normal development regions, reversal development regions and background regions, and the normal development regions are developed into visible images with a first developing agent, while the reversal development regions are developed into visible images with a second developing agent so that two kinds of visible images are formed on a photosensitive body, and thereafter the two kinds of visible images are transferred (recorded) onto a recording material such as a recording sheet.

With an electrostatic recording apparatus of this type, a sufficiently high contrast potential cannot be obtained unless the potential of a background region is maintained in a predetermined allowable range. In this case, the image density is lowered, or the developing agent sticks onto the background regions (hereinafter referred to as "a fogging phenomenon", when applicable) although it should not stick onto the background regions; that is, the resultant record is low in picture quality.

SUMMARY OF THE INVENTION

The present invention has been made in view of the above, and therefore an object of the invention is to provide an electrostatic recording apparatus and an electrostatic recording method in which no fogging phenomenon occurs, and both the normal development regions and the reversal development regions are satisfactorily developed into visible images; that is, the two kinds of visible images are clearly recorded.

The foregoing object of the invention has been achieved by the provision of an electrostatic recording apparatus in which

- a latent image is formed on a photosensitive body which is a combination of normal development regions, reversal development regions, and back ground regions, and
- the normal development region is developed into a visible image with a first developing agent while the reversal development region is developed into a visible image with a second developing agent whereby two kinds of visible images are formed on the photosensitive body, and
- the two kinds of visible images are collectively transferred and recorded on the photosensitive body,
- which apparatus, according to the invention, comprises:
  - background potential detecting means for detecting the potential of a background region adjacent to a normal development region and the potential of a background region adjacent to a reversal development region; and
  - control means for controlling, according to an output of the background potential detecting means, at least one selected from the group consisting of charge voltage, exposure intensity, and developing bias voltage.

In the electrostatic recording apparatus of the invention, the background region potential is determined with both the normal development and the reversal development taken into account. This feature results in the provision of sufficient contrast potential for any one of the development regions; that is, two kinds of visible images can be clearly recorded.

BRIEF DESCRIPTION OF THE DRAWINGS

The above and other objects and features of the present invention will be more apparent from the following description taken in conjunction with the accompanying drawings.

DETAILED DESCRIPTION OF THE PREFERRED EMBODIMENTS

Now, a description will be given of preferred embodiments of the invention with reference to the accompanying drawings.

(First Embodiment)

Figure 1:
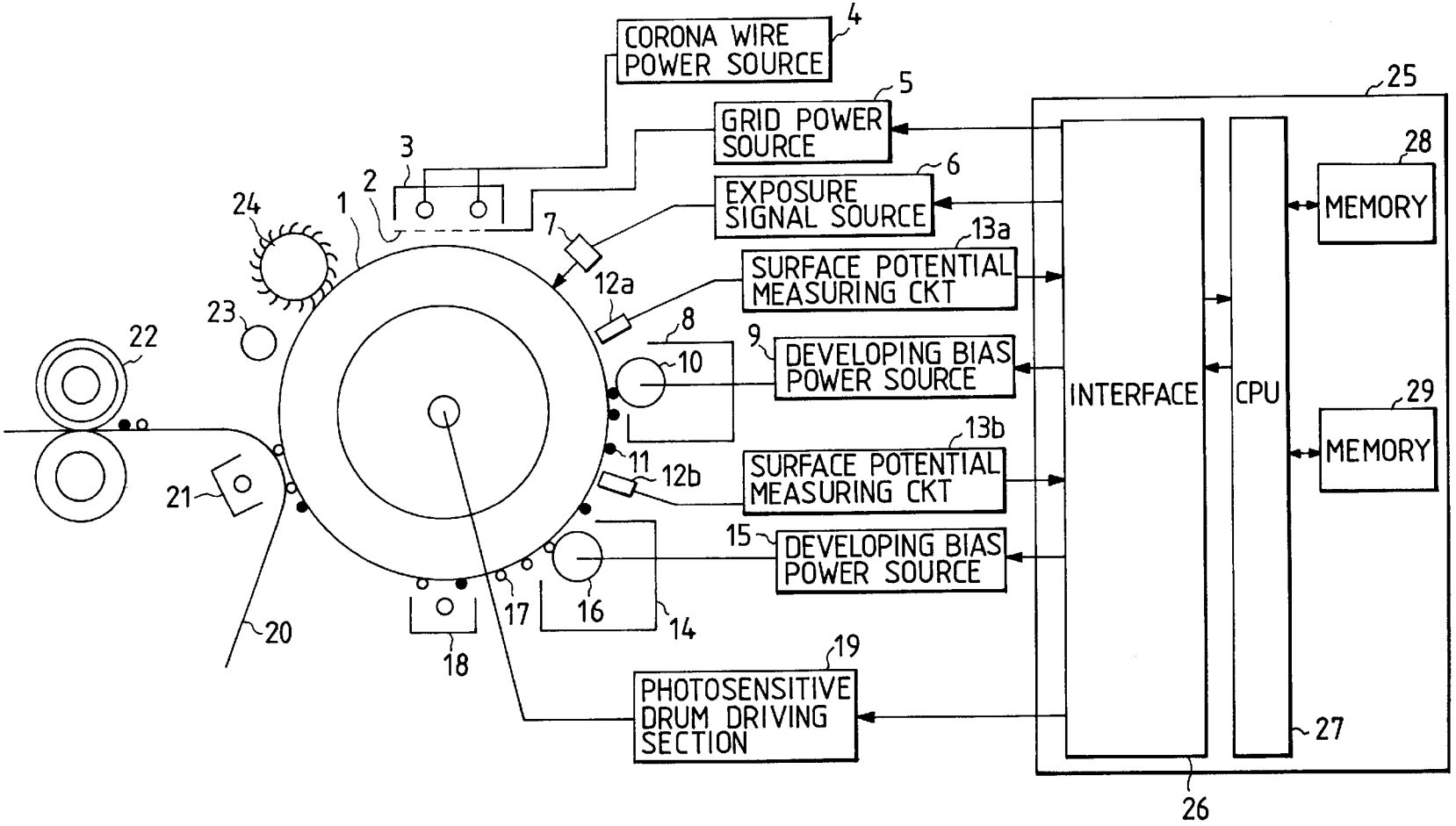
FIG. 1 is an explanatory diagram showing the arrangement of an electrostatic recording apparatus according to the invention.

FIG. 1 is a diagram showing the arrangement of an example of an electrostatic recording apparatus, which constitutes a first embodiment of the invention. In FIG. 1, reference numeral 1 designates a photosensitive drum comprising an electrically conductive base on which an organic photosensitive body (OPC) of negative charge type is formed; 3, a charging unit which is connected to a corona wire power source 4 to uniformly charge the photosensitive drum 1; 7, an exposing unit which employs a semiconductor laser or LED as its light source, to form a latent image which is a combination of normal development regions, reversal development regions and background regions; 8, a first developing unit which supplies positive charge toner to the normal development regions of the latent image formed by the developing unit 7, to develop the normal development regions into visible images; 14, a second developing unit which supplies negative charge toner to the reversal development regions of the latent image formed by the developing unit 7, to develop the reversal development regions into visible images; 18, a pre-transfer charger which inverts the charge polarity of one of the two kinds of visible images 11 and 17, thereby to make the visible images 11 and 17 equal in charge polarity; 21, a transferring unit which operates to transfer visible images on the photosensitive drum 1 onto a recording sheet 20; 22, a fixing unit which operates to fix the toner transferred onto the recording sheet 20; 23, an erasing unit which discharges the photosensitive drum 1 after the visible images have been transferred onto the recording sheet; and 24, a cleaner which is adapted to remove the toner from the photosensitive drum 1.

Background region potential detecting means, namely, surface potential sensors 12*a* and 12*b* are provided near the first developing unit 8 and the second developing unit 14, respectively. In the embodiment, with the relationship between the speed of rotation of the photosensitive drum and the positions of the developing units taken into account, the surface potential sensor 12*a* is provided at the position which corresponds to 0.5 second after the exposure, while the other surface potential sensor 12*b* is provided at the position which corresponds to one (1) second after the exposure. The outputs of the surface potential sensors 12*a* and 12*b* are applied to surface potential measuring circuits 13*a* and 13*b*, respectively, each of which comprises an amplifier, an A/D (analog-to-digital) converter, and an arithmetic circuit. The surface potential measuring circuits 13*a* and 13*b* apply arithmetic data to a control section 25. In response to the arithmetic data from the surface potential measuring circuits, the control section 25 controls a grid power source 5 connected to the grid 2 of the charging unit 3, an exposure signal source 6, developing bias power sources 9 and 15, and a photosensitive drum driving section 19.

Further in FIG. 1, reference numeral 26 designates an interface through which the control section is coupled to an engine section in the electrostatic recording apparatus; 27, a CPU; and 28 and 29, memories which are adapted to store data which have been operated by the CPU 27. For instance, the memory 28 is a RAM, and the memory 29 is a ROM.

With the above-described electrostatic recording apparatus, a printing operation is carried out as follows:

The photosensitive drum 1 is uniformly charged with the charging unit 3, and then subjected to exposure with the exposing unit 7, as a result of which a latent image is formed on the photosensitive drum 1 which is a combination of normal development regions, reversal development regions and background regions. Thereafter, the normal development regions are developed into visible images with the first developing unit 8, and the reversal development regions are developed into visible images with the second developing unit 14, so that two kinds of visible images 11 and 17 are formed on the photosensitive drum 1. The charge polarity of one of the two kinds of visible images 11 and 17 are inverted with the pre-transfer charger 18, as a result of which the two kinds of visible images which are equal in charge polarity to each other are provided on the photosensitive drum 1. Those visible images 11 and 17 are transferred onto the recording sheet 20 by the charge attracting action of the transferring unit 21, and then the recording sheet 20 is conveyed by means of a heating roll and a pressing roll which form the fixing unit, while being nipped thereby; that is, the visible images 11 and 17 are fixed with the fixing unit. After the photosensitive drum 1 passes through the transfer position, a small amount of developing agent may remain on it. However, the developing agent is removed from the photosensitive drum 1 when the latter passes through the erasing unit 23 and the cleaner 24.

On the other hand, with respect to an electrostatic recording apparatus of this type, the present inventor has confirmed through experiments the following fact: Even if a beam providing background region potential is constant in the intensity of exposure, depending on the dark decay of the photosensitive body after the formation of the latent image and the leakage of charge which is due to the difference in the distribution of charges between the normal development and the reversal development, at the developing position the background regions are fluctuated in potential.

Figures 2A, 2B, 2C, 2D:
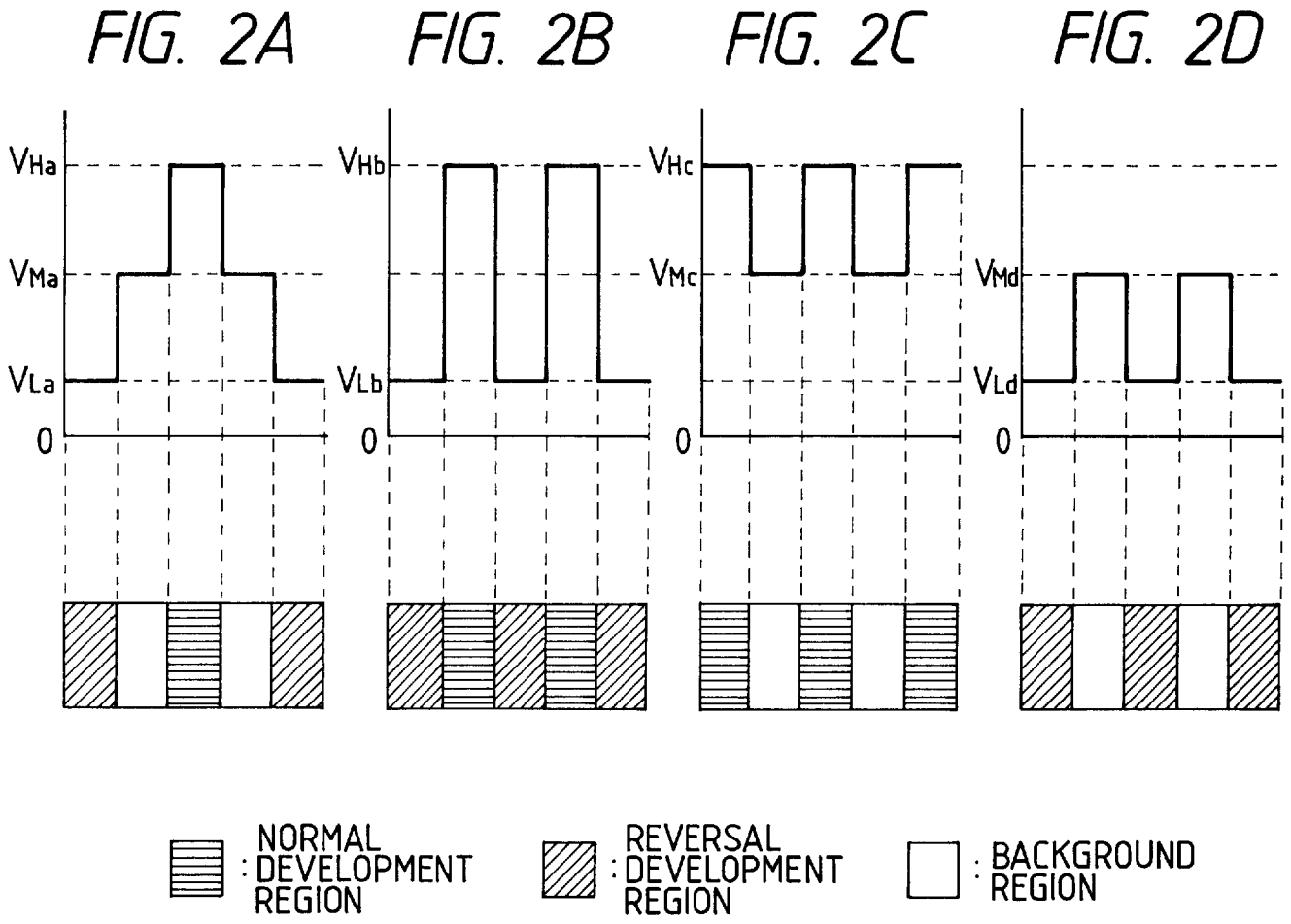
FIGS. 2A to 2D are diagrams for a description of a latent image pattern.

The reason why the background regions are not uniform in potential is as follows:

With an electrostatic recording system of this type, there are four latent image patterns as shown in FIGS. 2A to 2D which may be formed during image recording. A first latent pattern, as shown in FIG. 2A, consists of a reversal development region, a background region, a normal development region, a background region, and a reversal development region in the stated order. The second latent pattern, as shown in FIG. 2B, consists of a reversal development region, a normal development region, a reversal development region, a normal development region, and a reversal development region which occur in the stated order. The third latent pattern, as shown in FIG. 2C, consists of a normal development region, a background region, a normal development region, a background region, and a normal development region which occurs in the stated order. The fourth latent pattern, as shown in FIG. 2D, consists of a reversal development region, a background region, a reversal development region, a background region, and a reversal development region which occur in the stated order. In the case where, as shown in FIG. 2C, a normal developing region (VHc) is present next to a background region (VMc), the potential of the background region is not decreased so much, because charges leaking from the high potential side (the normal developing region) are supplied to the background region. On the other hand, in the case where, as shown in FIG. 2D, a reversal development region (VLd) is present next to a background region (VMd), charges leaks in one way from the background region to the low potential side (the reverse development region); that is, in this case, unlike the above-described case, no charge supplying phenomenon occurs, and therefore the background region is greatly decreased in potential. That is, those two cases are different in the decrease of potential. In the case of FIG. 2A, a reversal development region (VLa) is present on one side of a background region (VMa), while a normal development region (VHa) is on the other side of the background region (VMa), so that the above-described charge supplying phenomenon occurs. Hence, in the case of FIG. 2A, the decrease in the potential of the background region is not so great as in the case of FIG. 2D. The patterns shown in the lower portion of FIGS. 2A to 2D are those which are provided as visible images. For instance, black toner sticks onto the black region, and red toner sticks onto the hatched region, and no toner sticks onto the white region.

Figure 3:
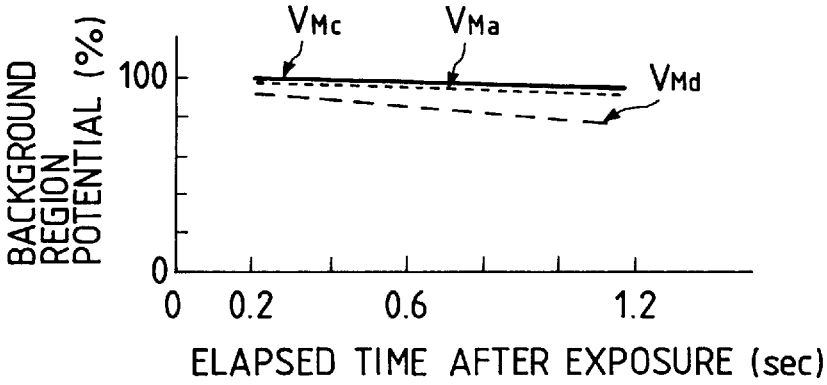
FIG. 3 is a graphical representation for a description of the variations in background region potential with time.

FIG. 3 is a graphical representation for a description of the variations of the background region potential VMa, VMc and VMd with time in the case where the latent patterns are formed on the organic photosensitive body (OPC) as shown in FIG. 2, indicating them with the value VMc as 100% which is obtained 0.2 second after the exposure of the photosensitive element. As is seen from FIG. 3, the background region which is sandwiched between two reversal development regions (VLd); that is, the background region (VMd) is largest in the decrease of potential. The background region which is sandwiched between a normal development region and a reversal development region; that is, the background region (VMa) is next in the decrease of potential to the background region (VMd). And the background region which is sandwiched between two normal development regions (VHc); that is, the background region (VMc) is smallest. Especially when the photosensitive body is deteriorated as the number of recorded sheets increases, the photosensitive body becomes difficult to be charged. Hence, the potential of the photosensitive body is lower than the initial potential of the latter, that is, the difference in potential due to the dark decay of the photosensitive body becomes significant. Furthermore, it has been found that, with a high humidity, the photosensitive body is lowered in surface resistance and in volume resistance, so that the difference in potential is increased. As is apparent from the above description, the background region potential is greatly changed depending on the latent image pattern, the deterioration of the photosensitive body, and the environmental condition. Hence, unless the potential control is carried out with those phenomena taken into account, the fogging phenomenon occurs with the background region depending on the latent image pattern, and the problem of deterioration in picture quality cannot be solved.

Figure 7:
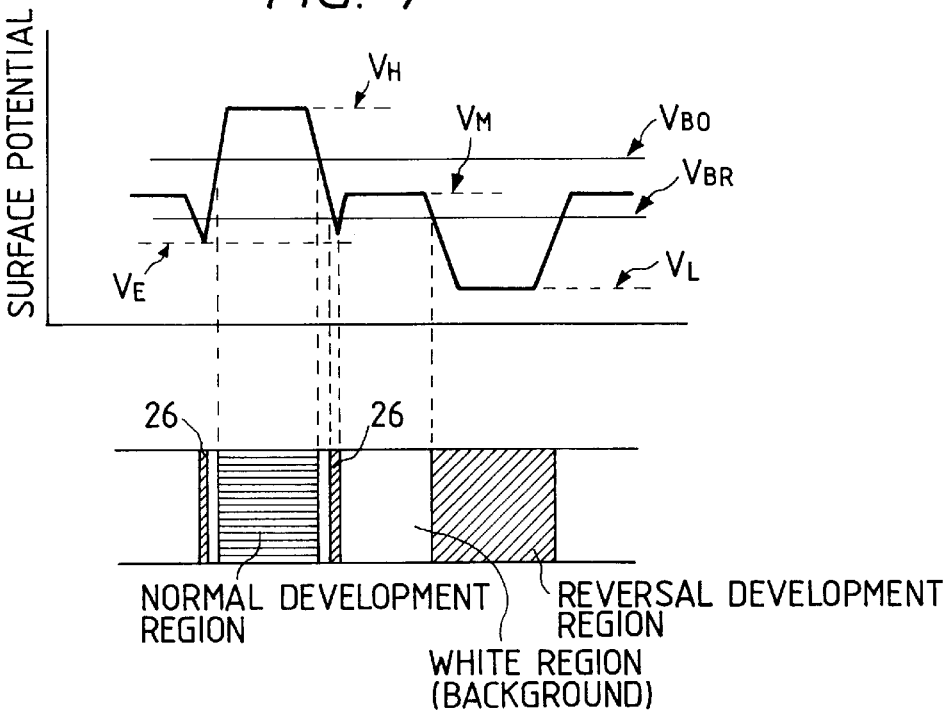
FIG. 7 is a diagram for a description of a fringe phenomenon.

FIG. 7 is a diagram for a description of a fringe field development in which the boundary between a normal development region and a background region is subjected to reversal development. This is a phenomenon (reversal development) that the periphery is developed in a color which is different from that of an image region (of normal development), and is due to the concentration of electric field to the edge region where the gradient of potential is large. When the background region potential is decreased, the fringe field is increased, so that the drop in the fringe potential VE becomes significant, and the fringe region is increased in density. To maintain the background region potential high is effective in preventing the formation of a fringe. On the other hand, it is necessary to make the developing bias voltage VBR of the second developing unit higher than the fringe voltage VE. In general, the difference between VMa and VE is less than 100V. Hence, if ΔV1 (=VMS (described later)−VBR) is set to 100V, then because of VMa>VMS, (VMa−VBR) higher than 100V. This feature prevents the occurrence of fringe phenomenon.

In view of the above-described difference in potential decrease, in the electrostatic recording apparatus of the invention, the potential control is performed prior to a printing operation, thereby to obtain sufficiently high contrast potential.

Now, the operation of the apparatus of the invention will be described in conjunction with the potential control.

Figure 4A:
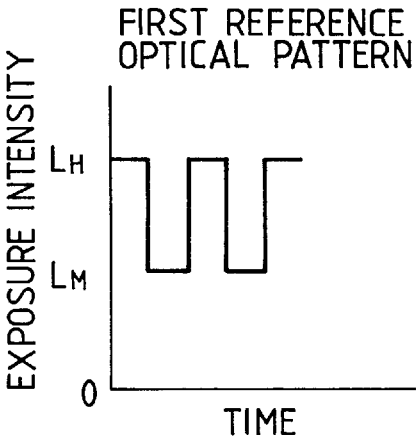
FIGS. 4A and 4B are graphical representations for a description of first and second reference optical patterns, respectively.

First of all, the photosensitive drum 1 is charged to about 800V, and a first reference optical pattern as shown in FIG. 4A is generated with the exposure signal source 6. Under this condition, the exposing unit 7 is operated; that is, the exposure of the drum 1 is carried out with the first reference optical pattern, so that a latent image consisting of reversal development regions (VLd) and background regions is formed (VMd) is formed. In FIG. 4A, the intensities of exposure LH and LM with the laser beam are feedback-controlled to predetermined values. Next, the background region potential VMd and the reversal development potential VLd are measured with the surface potential sensor 12*b* provided near the second developing unit 14 for reversal development. The measurement value VM1 of the background region potential is applied through the surface potential measuring circuit 13*b* to the control section 25, where it is compared with a predetermined reference value VMS, as a result of which the grid power source 5 is controlled that so VM1 is equal to VMS. In the concrete example of the embodiment shown in FIG. 1, the background region potential VM1 was 330V, and the reversal development region potential VLd was 60V. Furthermore, the reference value VMS was set to 450V. The grid power source 5 may be controlled as follows: The relationships between the background region potential VM1, the reference value VMS, and the grid voltage VG are stored in the memory 29 in advance, and according to the data thus stored the grid voltage VG is adjusted in response to the difference between VMS and VM1, or the grid voltage VG may be gradually increased. According to the results of measurement, in the concrete example, the grid voltage VG was adjusted to about 920V. Next, the developing bias voltage VBR of the second developing unit 14 for reversal development is set. More specifically, the developing bias voltage VBR is set to a value which is smaller by about 100V than the reference value VMS. Under this condition, the reversal development region potential VLd is 100V, and the contrast voltage (=VBR−VLd) is 250V. After the reversal developing conditions being corrected, the latent image is erased with the erasing unit 23.

Figure 4B:
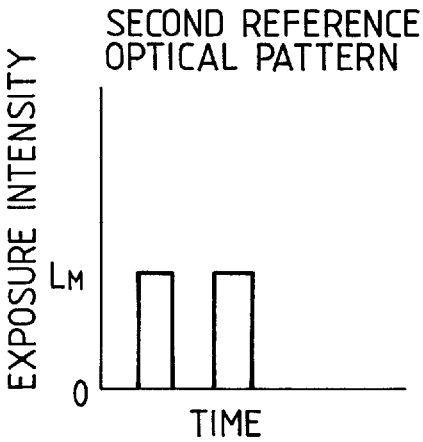

In the second revolution of the photosensitive drum 1, with the photosensitive drum 1 charged to about 920V which is the corrected grid voltage, a second reference optical pattern as shown in FIG. 4B is generated with the exposure signal source 6, and the photosensitive drum 1 is subjected to exposure with the exposing unit 7 by using the second reference optical pattern, so that a latent image consisting of normal development regions (VHc) and background regions (VMc) as shown in FIG. 2C is formed on the photosensitive drum 1. The normal development region potential VHc and the background region potential VMc are measured with the surface potential sensor 12*a* provided near the developing unit 8 for normal development, and the measured value VM2 is applied through the surface potential measuring circuit 13*a* to the control section 25. In the concrete example of the electrostatic recording apparatus, the normal development region potential VHc was 850V, and the background region potential VM2 was 490V. Before the charging operation, the background region potential was 390V, and the development bias voltage VBO of the first developing unit 8 was 480V; however, after the charging operation, the background region potential VM2 is increased to 490V, and therefore the control section 25 operated to adjust the development bias voltage VBO of the first developing unit 8 to 590V. The contrast potential (=VHc−VBO) was 260V. As was described above, while the photosensitive drum 1 makes two revolutions, the potential control is carried out, so that a contrast potential high enough for normal development and reversal development is obtained, which makes it possible to clearly record two kinds of visible images.

(Second Embodiment)

In the above-described first embodiment, two surface potential sensors 12*a* and 12*b* are employed. However, it should be noted that even with only one surface potential sensor, the same effect or merit may be obtained. Now, another example of the electrostatic recording apparatus will be described which employs one surface potential sensor, constituting a second embodiment of the invention.

Figure 5:
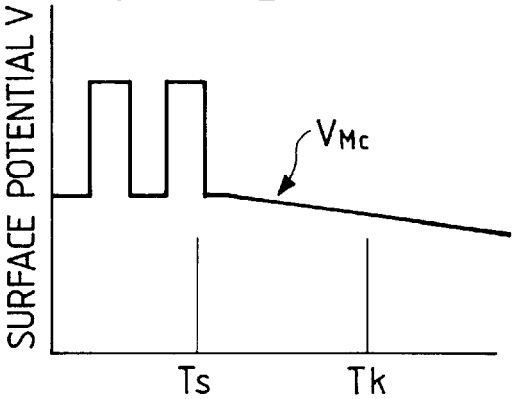
FIG. 5 is a graphical representation for a description of a surface potential measuring method concerning a second embodiment of the invention.

In the first revolution of the photosensitive drum 1, similarly as in the case of the above-described first embodiment the correction is carried out on the basis of the reversal development region. In the second revolution of the photosensitive drum 1, first the latter 1 is charged with the voltage of the grid 2 set to 930V, and the second reference optical pattern as shown in FIG. 4B is generated with the exposure signal source 6. Under this condition, the exposing unit 7 is operated; that is, the photosensitive drum 1 is subjected to exposure with the second reference optical pattern, so that a latent image consisting of normal development regions and background regions is formed on the photosensitive drum. Thereafter, at the time instant that the background region (VMc) reaches the position of the surface potential sensor 12*b*, the control section 25 applies a stop signal to the photosensitive drum driving section 19, to stop the rotation of the photosensitive drum 1. The surface potential sensor 12*b* measures the variations in dark decay of the background development potential as shown in FIG. 5, and the measured data are transmitted through the surface potential measuring circuit 13*b* to the control section 25. In FIG. 5, reference character TS designates the time instant when the .measurement of the dark decay of the background region potential VMc starts; and TK, the time instant when the measurement is ended. The inventor has confirmed it through experiments that if, under the conditions that VMc=VMcS when T=TS, and VMc=VMcK when T=TK, TK is within four (4) seconds, then VMC may be approximated according to the following expression (1):

$$VMC=VMcS\cdot e^{\{-\alpha(T-TS)\}} \quad (1)$$

$$\text{where } \alpha=\log e\ (VMcS/VMcK)/(TK-TS) \quad (2)$$

In the measurement of the background region potential, with TS=1.5 sec., VMcS=400V; and with TK=2 sec., VMcK=420V.

Hence, from expressions (1) and (2), $$VMc=440\cdot e^{\{-0.09(T-1.5)\}} \quad (3)$$

From expression (3), when TS=0.5 sec., at the position of the first developing unit, VMc was about 480V. Hence, the grid voltage is so controlled that the development bias voltage VBO of the first developing unit be 580V (=480+100).

In the second embodiment, at the position of the first developing unit the background region potential VMc is lower by about 10V than in the apparatus in which the potential control is carried out by using two surface potential sensors; however, this provides no problem in practical use. The second embodiment requires the operation of stopping the photosensitive drum 1, and the arithmetic operation; however, the second embodiment is advantageous in that it employs only one surface potential sensor instead of two, and accordingly it is unnecessary to perform adjustment between the two surface potential sensors.

(Third Embodiment)

Another example of the electrostatic recording apparatus, which constitutes a third embodiment of the invention, will be described. The third embodiment, similarly as in the case of the second embodiment, employs only one potential sensor, thus being simple in operation.

Figure 6:
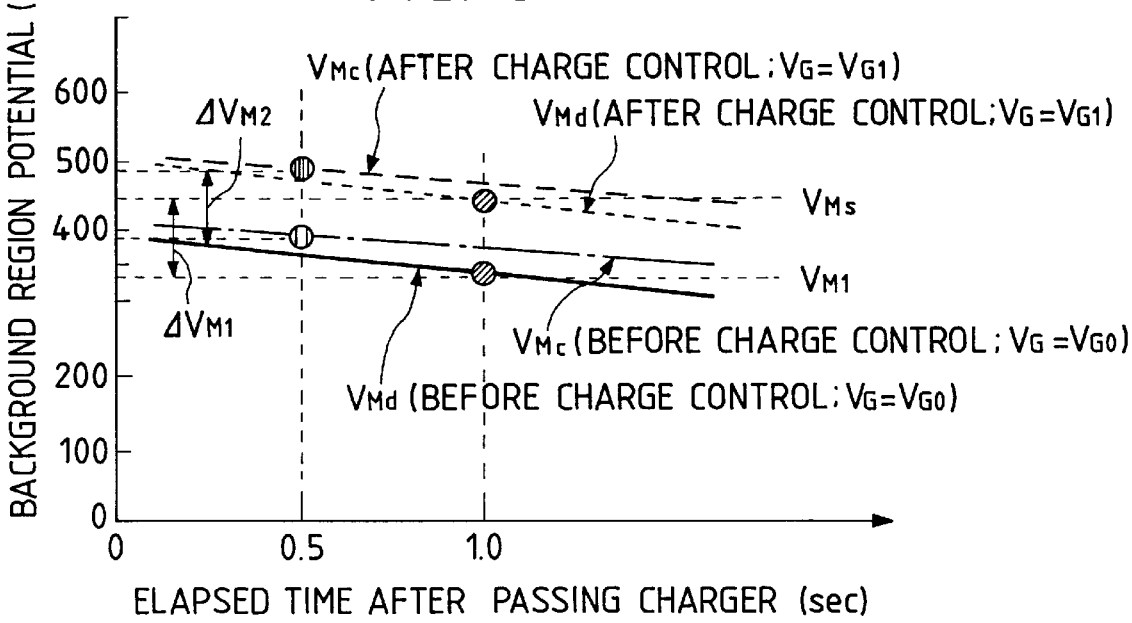
FIG. 6 is a graphical representation for a description of the control of the background region potential.

To maintain the background region potential high with respect to the reversal development region is carried out in the same manner as in the second embodiment. The background region potential with respect to the normal development region is maintained high as follows: In FIG. 6, before the charge control, VM1 is 330V, and during the charge control the set voltage is 450V. The difference ΔVM1 (=120V) between those voltages is a result of the fact that the charge current of the photosensitive body is increased as the grid voltage is increased from 800V to 920V. On the other hand, before the charge control, VM2 is 380V, and during the charge control the set voltage VM2 is 490V. The difference ΔVM2 between those voltages is 110V. Hence, ΔVM1 and ΔVM2 are substantially equal to each other, and the developing bias voltage VBO provided after the charge control is approximately made equal to the sum of the developing bias voltage VBO provided before the charge control and the difference ΔVM1. As a result, the developing bias voltage VBO provided after the charge control is 600V (=480V+120V). This method is effective in the case where the difference between ΔVM2 and ΔVM1 is small; that is, in the case where the photosensitive body is not so deteriorated. In the above-described method, the potential control can be achieved in one operating step; that is, it can be performed during a relatively short period of time such as data waiting time.

In general, in the case where the electrostatic recording device is started, the temperature inside the apparatus is different from the room temperature (ambient temperature), and therefore it takes at most several tens of minutes until the temperature inside the apparatus is stabilized. During this period, the background region potential is changed as the photosensitive body changes in sensitivity with temperature. In this case, the potential control must be achieved quickly. Hence, at the start of the apparatus, the method according to the first embodiment should be employed, and, after the start of the apparatus, as for the change in temperature the method according to the third embodiment should be employed.

As is apparent from the above description, with the electrostatic recording apparatus and method according to the invention, the normal development region and the reversal development region can be satisfactorily developed into visible images; that is, two kinds of visible images can be clearly recorded.

The foregoing description of a preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An electrostatic recording device in which a latent image which is a combination of normal development regions, reversal development regions and background regions is formed on a photosensitive body by a single exposing unit, and the normal development regions are developed into a visible image with a first developer and the reversal development regions are developed into a visible image with a second developer to form two kinds of visible images on the photosensitive body, and the two kinds of visible images are transferred onto a recording material together, said recording device comprising:

background potential detecting means for detecting potentials of the background regions adjacent to the normal development regions and potentials of the background regions adjacent to the reversal development regions, individually; and control means for controlling at least one of charging voltage, exposure intensity and development bias voltage on the basis of an output of said background potential detecting means.

2. An electrostatic recording apparatus as claimed in claim 1, wherein said background potential detecting means comprises first and second surface potential sensors; and wherein said first and second surface potential sensors are provided in the vicinity of said normal developing unit and said reversal developing unit, respectively.

3. An electrostatic recording apparatus as claimed in claim 1, wherein said background potential detecting means comprises a single surface potential sensor; and wherein said single surface potential sensor is provided between said normal developing unit and said reversal developing unit.

4. An electrostatic recording method in which an optical pattern which is a combination of exposure intensities LL, LM and LH (where LL<LM<LH) is projected onto a photosensitive body whereby a latent image consisting of latent image regions which are at potentials VH, VM and VL (where VH>VM>VL) is formed on said photosensitive body, said latent image regions at said potentials VH are developed into visible images with a normal developing unit while said latent image regions at said potential VL are developed into visible images with a reversal developing unit, whereby tow kinds of visible images are recorded in one process, said method comprising the steps of:

prior to said recording operation, said photosensitive body is operated to make to revolutions in such a manner that, at the first revolution of said photosensitive body, (a) projecting a first reference optical pattern having exposure intensities LM and LH onto said photosensitive body which has been charged to form a latent image including latent image regions at potentials VM and VL on said photosensitive body;

(b) at the position of said reversal developing unit, measuring the value of said potential VM with potential detecting means to obtain a measurement value VM1, and (c) controlling a charge voltage so that said measurement value VM1 is set to a predetermined reference value VMS, while controlling a developing bias voltage VBR of said reversal developing unit so as to be smaller than said reference value VMS, and at the second revolution of said photosensitive body, (d) charging said photosensitive body according to said charge voltage controlled in said step (c);

(e) projecting a second reference optical pattern having exposure intensities LM and LL onto said photosensitive body thus charged, to form a latent image including latent image regions at potentials VM and VH on said photosensitive body, (f) at the position of said normal developing unit, detecting the value of said potential VM with potential detecting means to obtain a measurement value VM2, and (g) controlling a developing bias voltage VBO of said normal developing unit so as to be larger than said measurement value VM2.

5. An electrostatic recording method as claimed in claim 4, wherein said developing bias voltage is controlled to satisfy the following equation:

$$VBO=VBOP+(VMS-VM1)$$

where VBO is the developing bias voltage of said first developing unit, and VBOP is the developing bias voltage before said charge voltage control is effected.

6. An electrostatic recording method in which an optical pattern which is a combination of exposure intensities LL, LM and LH, (where LL<LM<LH) is projected on a photosensitive body whereby a latent image consisting of latent image regions which are at potentials VH, VM and VL (where VH>VM>VL) is formed on said photosensitive body, said latent image regions at said potential VH are developed into visible images with a normal developing unit while said latent image regions at said potential VL are developed into visible images with a reversal developing unit, whereby two kinds of visible images are recorded in one process, and single potential detecting means is provided between said normal developing unit and said reversal developing unit, said method comprising the steps of:

prior to said recording operation, said photosensitive body is operated to make two revolutions in such a manner that, at the first revolution of said photosensitive body, (a) projecting a first reference optical pattern having exposure intensities LM and LH onto said photosensitive body which has been charged, to form a latent image consisting of latent image regions at potentials VM and VL on said photosensitive body, (b) at the position of said reversal developing unit, measuring the value of said potential VM with potential detecting means to obtain a measurement value VM1, (c) controlling a charge voltage so that said measurement value VM is set to a predetermined reference value VMS, while controlling a developing bias voltage VBR of said reversal developing unit so as to be smaller than said reference value VMS, and at the second revolution of said photosensitive body, (d) charging said photosensitive body according to said charge voltage controlled in said step (c), (e) projecting a second reference optical pattern having exposure intensities LM and LL onto said photosensitive body charged in said step (d), to form a latent image consisting of latent image regions at potentials VM and VH on said photosensitive body, (f) when said latent image region at the potential VM formed in said step (e) on said photosensitive body reaches the position of said potential detecting means, stopping the rotation of said photosensitive body, (g) measuring the variation in the potential VM with time so as to measure at the position of said normal developing unit, the value of said potential VM to obtain a measurement value VM2, and (h) controlling a developing bias voltage VBO of said normal developing unit so as to be larger than said measurement value VM2.

* * * * *